US010415533B2

(12) United States Patent
Kosuge et al.

(10) Patent No.: US 10,415,533 B2
(45) Date of Patent: Sep. 17, 2019

(54) IGNITION APPARATUS HAVING CIRCUIT TO CONTINUE SPARK DISCHARGE IN AN INTERNAL COMBUSTION ENGINE

(71) Applicants: DENSO CORPORATION, Kariya, Aichi-pref. (JP); SOKEN, INC., Nishio, Aichi-pref. (JP)

(72) Inventors: Hideaki Kosuge, Nishio (JP); Fumiaki Aoki, Nishio (JP); Shohei Ishida, Nishio (JP); Shunichi Takeda, Kariya (JP); Kazuaki Ueda, Nishio (JP)

(73) Assignees: DENSO CORPORATION, Kariya (JP); SOKEN, INC., Nishio (JP)

( * ) Notice: Subject to any disclaimer, the term of this patent is extended or adjusted under 35 U.S.C. 154(b) by 0 days.

(21) Appl. No.: 15/573,914

(22) PCT Filed: May 12, 2016

(86) PCT No.: PCT/JP2016/064080
§ 371 (c)(1),
(2) Date: Nov. 14, 2017

(87) PCT Pub. No.: WO2016/185988
PCT Pub. Date: Nov. 24, 2016

(65) Prior Publication Data

US 2018/0266381 A1 Sep. 20, 2018

(30) Foreign Application Priority Data

May 15, 2015 (JP) ..... 2015-100264

(51) Int. Cl.
*F02P 3/00* (2006.01)
*F02P 15/10* (2006.01)
(Continued)

(52) U.S. Cl.
CPC ..... *F02P 15/10* (2013.01); *F02P 3/053* (2013.01); *F02P 9/007* (2013.01); *F02P 17/12* (2013.01);
(Continued)

(58) Field of Classification Search
CPC .. F02P 15/10; F02P 3/0442; F02P 3/02; F02P 17/12; F02P 2017/121; F02P 9/007; F02P 9/002; F02P 5/145; Y02T 10/46
(Continued)

(56) References Cited

U.S. PATENT DOCUMENTS 9,291,142 B2 * 3/2016 Mori ..... F02P 17/12
9,771,918 B2 * 9/2017 Nakayama ..... F02P 3/0453
(Continued)

FOREIGN PATENT DOCUMENTS

EP 3 199 797 A1 8/2017
EP 3 199 799 A1 8/2017
(Continued)

*Primary Examiner* — Hai H Huynh
*Assistant Examiner* — Gonzalo Laguarda
(74) *Attorney, Agent, or Firm* — Nixon & Vanderhye PC

(57) ABSTRACT

An ignition apparatus for internal combustion engines is provided. The ignition apparatus is equipped with an ECU. The ECU monitors a path length of a discharge of a spark for a period of time in which a second circuit delivers or inputs energy in the form of a threshold value determination. When the path length has become too short, the ECU determines that ignition is expected to be delayed and then selects a special mode to control the delay of the ignition. The ECU increase a target value of an energy input amount. This enables the delay of ignition resulting from a short extension of the path length to be minimized. The ignition apparatus equipped with the second circuit to continue the discharge of
(Continued)

sparks is, thus, capable of reducing a variation in ignition without the need for uniformly increasing the energy input amount.

8 Claims, 9 Drawing Sheets

(51) Int. Cl.

| | |
|---|---|
| ***F02P 17/12*** | (2006.01) |
| ***F02P 3/05*** | (2006.01) |
| ***F02P 9/00*** | (2006.01) |
| ***H01T 13/58*** | (2011.01) |
| *F02P 3/04* | (2006.01) |
| *F02D 41/14* | (2006.01) |
| *F02P 3/08* | (2006.01) |
| *F02D 35/02* | (2006.01) |

(52) U.S. Cl.
CPC ..... *H01T 13/58* (2013.01); *F02D 35/023* (2013.01); *F02D 41/1454* (2013.01); *F02P 3/0442* (2013.01); *F02P 3/0892* (2013.01); *F02P 2017/121* (2013.01)

(58) Field of Classification Search
USPC ..... 123/605, 618, 620, 621, 622
See application file for complete search history.

(56) References Cited

U.S. PATENT DOCUMENTS

| | | | | |
|---|---|---|---|---|
| 2011/0168145 | A1 | 7/2011 | Mori | |
| 2014/0345565 | A1 | 11/2014 | Mori | |
| 2016/0047352 | A1 | 2/2016 | Nakayama et al. | |
| 2016/0208732 | A1* | 7/2016 | Mori | F02D 41/0072 |

FOREIGN PATENT DOCUMENTS

| | | |
|---|---|---|
| JP | 2013-024060 | 2/2013 |
| JP | 2015-072003 | 4/2015 |

* cited by examiner

YES THRESHOLD DETERMINATION

NO THRESHOLD DETERMINATION (SMALL L)

SHORT CIRCUIT

SURFACE DISCHARGE

IGNITION APPARATUS HAVING CIRCUIT TO CONTINUE SPARK DISCHARGE IN AN INTERNAL COMBUSTION ENGINE

This application is the U.S. national phase of International Application No. PCT/JP2016/064080 filed May 12, 2016 which designated the U.S. and claims priority to JP Patent Application No. 2015-100264 filed May 15, 2015, the entire contents of each of which are hereby incorporated by reference.

TECHNICAL FIELD

The invention is generally relates to an internal combustion engine ignition apparatus.

BACKGROUND ART

An ignition apparatus is known which includes an ignition coil equipped with a primary coil and a secondary coil and a spark plug connected to the secondary coil, and works to input energy to the spark plug by means of electromagnetic induction arising from energization and deenergization of the primary coil, thereby creating spark discharges.

Japanese Patent First Publication No. 2014-218995 discloses an ignition apparatus which is designed to continue to develop sparks once a spark is initiated. The ignition apparatus is equipped with a first and a second circuits, as described below.

Specifically, the first circuit energizes or deenergizes the first coil to start producing sparks in the spark plug. The first circuit connects a plus (+) terminal of a battery and a plus terminal of the primary coil, connects a minus terminal of the primary coil to ground, and has a discharge start switch (which will be referred to as a first switch) disposed on a minus side of the primary coil.

The second circuit works to produce a flow of electrical current through the primary coil in a direction opposite that produced by the first circuit during the spark initiated by the first circuit, thereby keeping a flow of electric current through the secondary coil in the same direction as that initiated by the first circuit to continue input of energy to the spark plug, thereby maintaining the production of sparks. The second circuit has a switch (which will be referred to below as a second switch) which is disposed, for example, between the primary coil and an ignition switch and works to supply or block electric power to the primary coil from a step-up circuit.

The electrical energy generated by the step-up circuit is inputted by turning on or off of the second switch to the negative side of the primary coil to continue to produce sparks, thereby reducing load on the spark plug and saving consumption of electrical power.

The ignition apparatus for internal combustion engines is required to minimize a variation in time interval between start of discharge of sparks and ignition of fuel (which will also be referred to below as ignition variation) in order to minimize combustion fluctuation. The ignition variation may be decreased by increasing the amount of energy inputted to the spark plug in all combustion cycles. The increase in input amount of energy, however, results in increases in load on the spark plug and consumption of electric power. How to reduce the ignition variation without increasing the input amount of energy is, therefore, sought.

Japanese Patent First Publication No. 2013-024060 teaches an ignition apparatus for internal combustion engines designed to control the so-called blowout. The blowout, as referred to herein, is a phenomenon where a path (which will also be referred to below as a spark path) of a spark is extended and then cut by gas flow, so that a spark occurs again. Japanese Patent First Publication No. 2013-024060 is, however, silent about the problem of the ignition variation and does not suggest how to reduce the ignition variation.

SUMMARY OF THE INVENTION

Problem to be Solved by the Invention

The invention was made in view of the above problems. It is an object to provide an ignition apparatus which has a second circuit to continue spark discharges and reduces an ignition variation without need for increasing an amount of energy inputted to a spark plug.

Means for Solving the Problem

An ignition apparatus of this invention is equipped with an ignition coil including a primary coil and a secondary coil and a spark plug connected to the secondary coil and works to input energy to the spark plug using electromagnetic induction resulting from energization and deenergization of the primary coil, thereby producing a discharge of a spark.

The ignition apparatus is equipped with a first circuit, a second circuit, and a control portion. The first circuit energizes or deenergizes the primary coil to initiate a discharge of a spark in the spark plug. The second circuit produces a flow of current through the primary coil in a direction opposite a direction in which a flow of current through the primary coil was produced by the first circuit during the discharge of the spark initiated by the first circuit, thereby keeping a flow of current through the secondary coil in the same direction as when a flow of current through the secondary coil has been initiated by the first circuit, to continue a spark discharge. The control portion controls operations of the first circuit and the second circuit.

The control portion works to calculate a path length of a discharge of a spark between electrodes of the spark plug and has a threshold value for the path length. The control portion has, as control modes for the second circuit, a normal mode in which is entered when a calculated value of the path length is greater than said threshold value and a special mode which is entered when the calculated value of the path length is smaller than said threshold value. In the special mode, an energy input amount of energy inputted by the second circuit is increased to be more than that in the normal mode.

This invention focuses on the fact that a variation in ignition, especially, the delay of the ignition is caused by a decrease in the path length. In other words, the ignition is achieved by extension of a spark by a gas flow in the cylinder, thereby prolonging the path length. Therefore, when the path length is short, there is a risk that the ignition is delayed.

Accordingly, the path length of a discharge of a spark is calculated. A threshold value is provided for the path length. When a calculated value of the path length is smaller than the threshold value, the special mode is selected to increase an energy input amount of energy inputted by the second circuit is increased with a decrease in the calculated value.

This controls the delay of the ignition resulting from a short extension of the path length of the discharge of a spark. The ignition apparatus which is equipped with the second circuit to continue the discharge of sparks is, therefore, capable of decreasing the variation in ignition without the need for uniformly increasing the energy input amount.

BRIEF DESCRIPTION OF THE DRAWINGS

FIG. 3(*b*) is an explanatory view which illustrates a discharge path when a NO answer is obtained in a threshold determination.

FIG. 3(*c*) is an explanatory view which illustrates a discharge path in the event of a short circuit.

FIG. 3(*d*) is an explanatory view which illustrates a discharge path in the event of a surface spark.

FIG. 6(*b*) is a time chart which represents a time sequential change in a path length when a variation in the path length is great in the event of a short circuit (Embodiment).

FIG. 6(*c*) is a time chart which represents a time sequential change in a path length when the path length is kept short without being increased after a short circuit occurs (Embodiment).

FIG. 8(*b*) is an explanatory view which represents a relation between a variation in path length and an energy input amount in the event of a short circuit (Embodiment).

EMBODIMENT FOR CARRYING OUT THE INVENTION

Embodiments for carrying out the invention will be described using the drawings. The embodiments are merely examples. The invention should not be limited to the embodiments.

Embodiment

Structure of Embodiment

Figure 1:
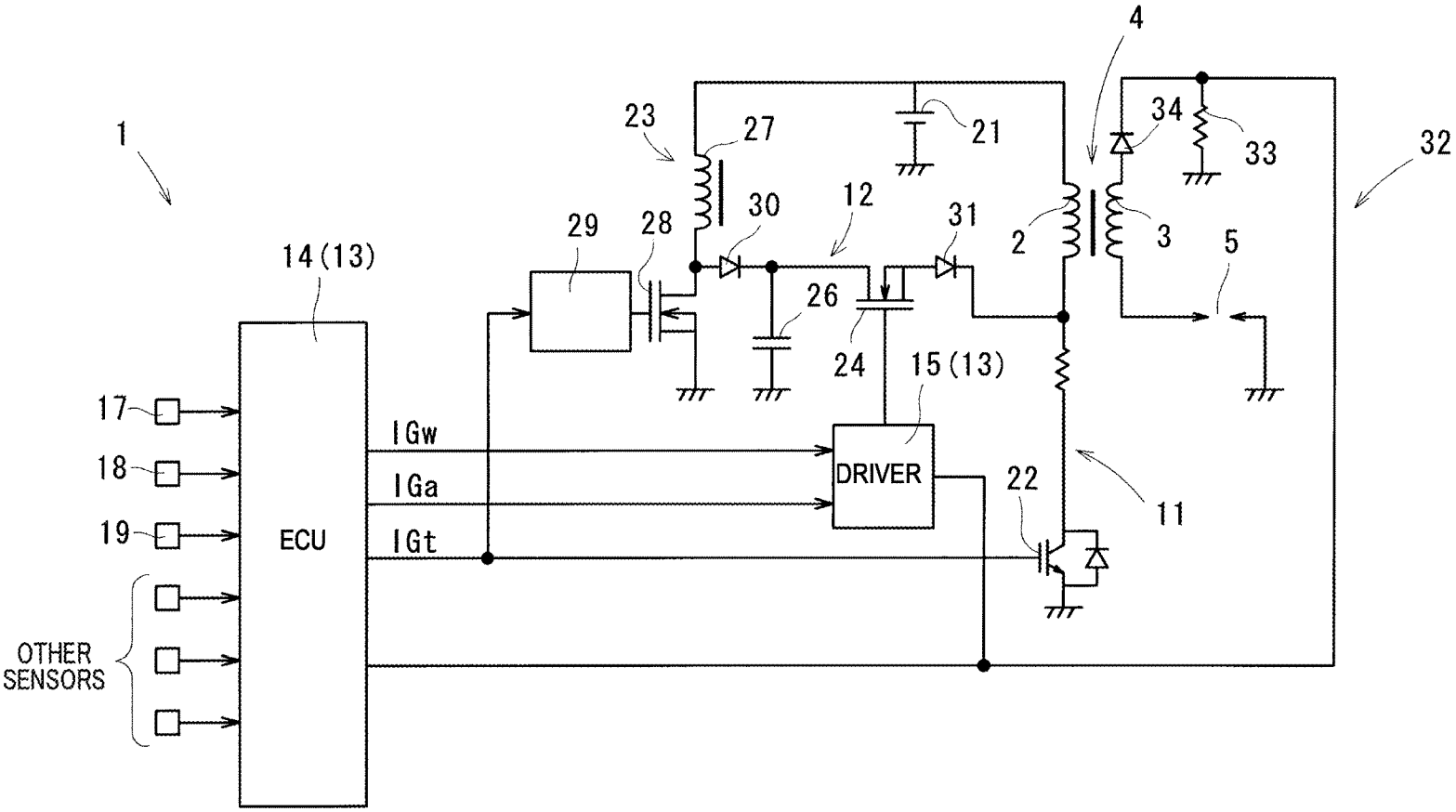
FIG. 1 is a structural view of an ignition apparatus (Embodiment).
Figure 2:
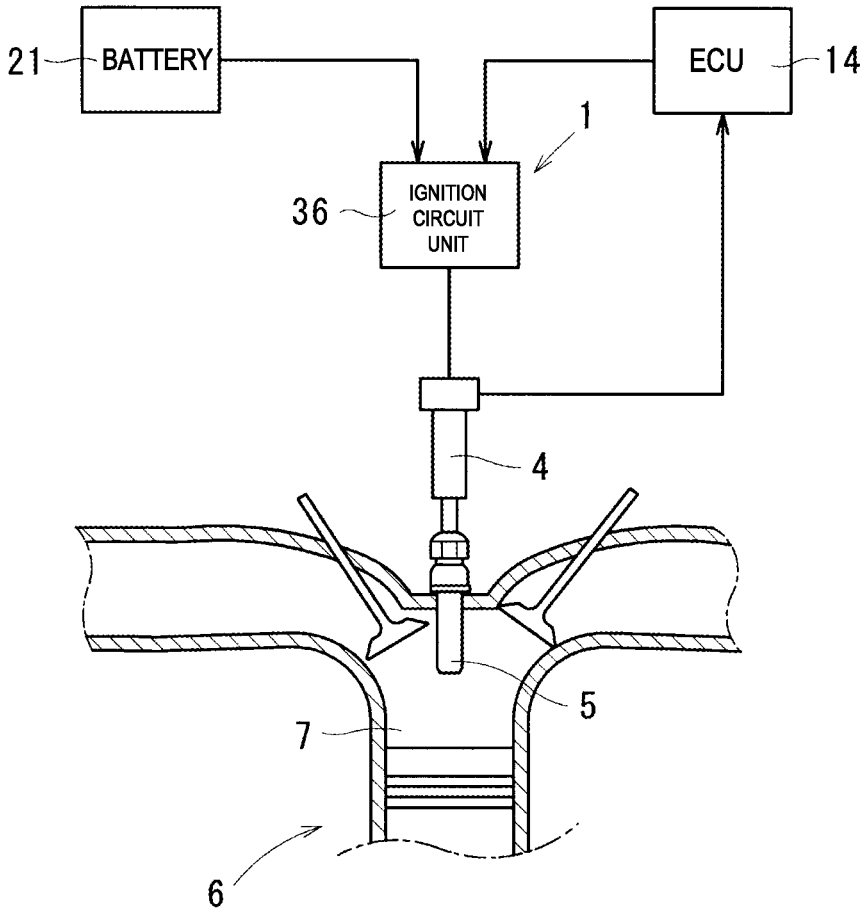
FIG. 2 is an overall structural view of an ignition apparatus and an internal combustion engine (Embodiment).
Figure 3A:
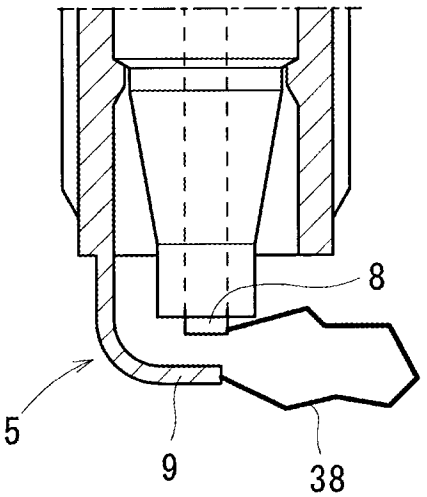
FIG. 3(*a*) is an explanatory view which illustrates a discharge path when a YES answer is obtained in a threshold determination.
Figure 3B:
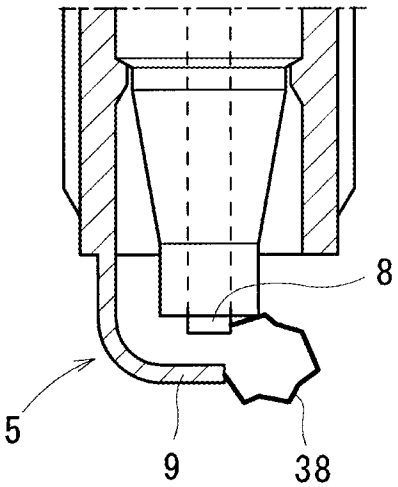
Figure 3C:
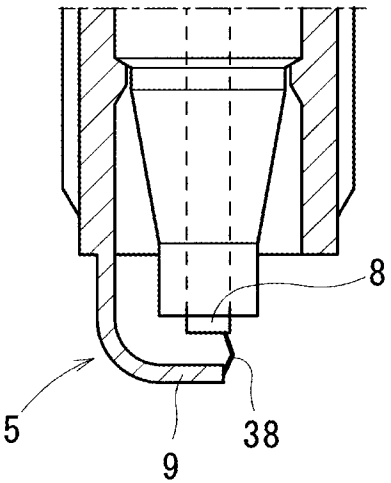
Figure 3D:
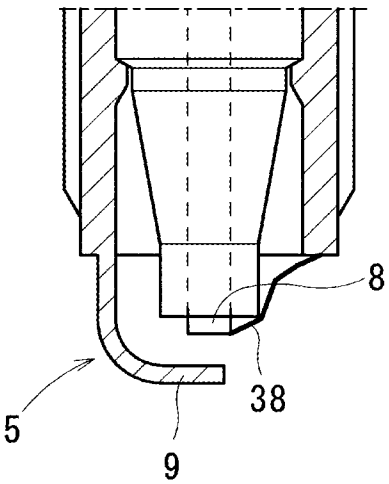

The ignition apparatus 1 of an embodiment will be described below with reference to FIGS. 1 to 3.

The ignition apparatus 1 includes the ignition coil 4 equipped with the primary coil 2 and the secondary coil 3 and the spark plug 5 connected to the secondary coil 3. The ignition apparatus 1 works to input or delivery energy to the spark plug 5 through electromagnetic induction resulting from energization and deenergization of the primary coil 2 to create a spark. The ignition apparatus 1 is mounted on the internal combustion engine 6 for use in driving the vehicle and works to ignite air-fuel mixture in the cylinder 7 at a given ignition time.

The spark plug 5 has a known structure and is, as illustrated in FIGS. 3(*a*) to 3(*d*), equipped with the center electrode 8 connected to an end of the secondary coil 3 and the ground electrode 9 connected to ground through a cylinder head of the internal combustion engine 6. The energy produced by the secondary coil 3 is used to create sparks between the center electrode 8 and the ground electrode 9.

The internal combustion engine 6 is of, for example, a direct injection type which is capable of performing lean-burn of fuel, i.e., gasoline and in which a spiral flow, such as a swirl or a tumble flow of air-fuel mixture is created in the cylinder 7.

The ignition apparatus 1 will be described below in detail.

The ignition apparatus 1 is equipped with the first and second circuits 11 and 12 and the control portion 13. The first circuit 11 works to energize and then deenergize the primary coil 2 to initiate discharge of sparks in the spark plug 5. The second circuit 12 works to create a flow of electric current through the primary coil 2 in a direction opposite a direction in which a flow of electric current was produced by the first circuit 11 through the primary coil 2 during discharge of a spark initiated by the first circuit 11, thereby keeping a flow of electric current through secondary coil 3 in the same direction as when the energization of the secondary coil 3 has been initiated by the operation of the first circuit 11 to continue to input or delivery energy to the spark plug 5, thereby achieving continuation of discharge of sparks. The control portion 13 works to control the operations of the first and second circuits 11 and 12 and is made up of an electronic control unit (which will also be referred to below as the ECU 14) and the driver 15.

The ECU 14 functions as a central control for the internal combustion engine 6 and outputs a variety of signals, such as the ignition signal IGt and the discharge-continuing signal IGw, to control the energization of the primary coil 2, thereby regulating electrical energy induced in the secondary coil 3 to control the discharge of sparks in the spark plug 5. The ignition signal IGt and the discharge-continuing signal IGw will be discussed later.

The ECU 14 receives inputs from a variety of different sensors which are mounted in the vehicle and measure parameters representing operating and controlled conditions of the internal combustion engine 6. The ECU 14 is equipped with an input circuit, a CPU, memories, a control circuit. The input circuit processes signals inputted thereto. The CPU performs control and operation tasks for controlling the internal combustion engine 6 using the input signals. The memories store therein data and programs required to control the internal combustion engine 6. The output circuit works to output signals required to control the internal combustion engine 6 using results of the operations of the CPU.

The sensors which output signals to the ECU 14 include the rotational speed sensor 17, the intake pressure sensor 18, and the air-fuel ratio sensor 19. The rotational speed sensor 17 works to measure a rotational speed of the internal combustion engine 6. The intake pressure sensor 18 works to measure the pressure of intake air sucked into the internal combustion engine 6. The air-fuel ratio sensor 19 works to measure an air-fuel ratio of the mixture. The ECU 14 performs ignition control or fuel injection control for the internal combustion engine 6 using parameters derived by the above sensors.

The first circuit 11 connects between the positive (+) terminal of the battery 21 and one of ends of the primary coil 2 (which will also be referred to as a first terminal) and also connects the other end of the primary coil 2 (which will also be referred to below as a second terminal) and has a discharge start switch (which will be referred to below as a first switch 22) disposed on the ground side (i.e., the second terminal that is a low potential side) of the primary coil 2.

The first circuit 11 turns on and off the first switch 22 to store energy in the primary coil 2 and also uses the energy in the primary coil 2 to develop high voltage in the secondary coil 3 for initiating discharge of a spark in the spark plug 5.

The discharge of a spark created by the operation of the first circuit 11 will be referred to below as main spark-ignition. The direction of energization of the primary coil 2 (i.e., a direction in which the primary current flows) from the battery 21 to the first switch 22 will also be referred to as a plus side.

More specifically, the first circuit 11 turns on the first switch 22 for a period of time in which the ignition signal IGt is inputted by the ECU 14 to the first switch 22, thereby applying the voltage from the battery 21 to the primary coil 2 to produce a flow of a positive primary current therethrough, thereby storing magnetic energy in the primary coil 2. Afterwards, the first circuit 11 turns off the first switch 22 to develop high voltage at the secondary coil 3 through electromagnetic induction to create the main spark-ignition.

The first switch 22 is implemented by a power transistor, a MOS transistor, or a thyristor. The ignition signal IGt is a command signal indicating a period of time for which the first circuit 11 stores the energy in the primary coil 2 and the ignition timing (i.e., a spark start time).

The second circuit 12 connects with the first circuit 11 between the primary coil 2 and the first switch 22 and has a switch (which will also be referred to as a second switch 24) which establishes or blocks a supply of electrical power from the step-up circuit 23 to the primary coil 2.

The step-up circuit 23 works to step-up the voltage at the battery 21 and store it in the capacitor 26 for a period of time in which the ignition signal IGt is outputted from the ECU 14. Specifically, the step-up circuit 23 is equipped with the capacitor 26, the choke coil 27, the step-up switch 28, the step-up driver 29, and the diode 30.

The choke coil 27 is connected at an end thereof to the positive terminal of the battery 21 and energized or deenergized by the step-up switch 28. The step-up driver 29 outputs a control signal to the step-up switch 28 to turn on or off the step-up switch 28. The magnetic energy which is generated in the choke coil 27 by the on-off operations of the step-up switch 28 is stored as electrical energy in the capacitor 26.

The step-up driver 29 cyclically turns on and off the step-up switch 28 at a given interval for a period of time in which the ignition signal IGt is inputted thereto from the ECU 14. The diode 30 serves to avoid a backflow of the energy, as stored in the capacitor 26, to the choke coil 27. The step-up switch 28 is implemented by, for example, a MOS transistor.

The second circuit 12 is equipped with the second switch 24 and the diode 31. The second switch 24 is implemented by, for example, a MOS transistor and works to selectively delivery the energy, as stored in the capacitor 26, to the negative side of the primary coil 2. The diode 31 serves to avoid a backflow of current from the primary coil 2 to the second switch 24. The second switch 24 is turned on in response to a control signal from the driver 15 to deliver the energy from the step-up circuit 23 to the negative side of the primary coil 2.

The driver 15 turns on and then off the second switch 24 for a period of time in which the discharge-continuing signal IGw is inputted thereto, thereby controlling the energy delivered or inputted from the capacitor 26 to the primary coil 2 to control the secondary current that is a function of a degree to which the secondary coil 3 is energized. The driver 15 will be referred to below as an energy inputting driver 15. The discharge-continuing signal IGw is a command signal which indicates a period of time for which the spark discharge, as initiated as the main spark-ignition, is maintained. More specifically, the discharge-continuing signal IGw is a signal indicating an energy input duration in which the second switch 24 is cyclically turned on and off to deliver or input the energy from the step-up circuit 23 to the primary coil 2.

As apparent from the above discussion, the second circuit 12 creates a flow of electric current through the primary coil 2 in a direction opposite a direction of a flow of electric current produced by the first circuit 11 through the primary coil 2 during discharge of a spark which has been initiated by the first circuit 11, thereby keeping a flow of the secondary current in the same direction as when the secondary current has been initiated by the operation of the first circuit 11 to continue the discharge of sparks.

In the following discussion, discharge of sparks, as created by the operation of the second circuit 12, following the main spark-ignition will also be referred to as a continuing spark discharge.

The energy inputting driver 15 receives the current command signal IGa from the ECU 14 which indicates a command value of the secondary current and then controls the secondary current based on the current command signal IGa.

The secondary coil 3 is, as described above, connected at the first end thereof to the center electrode 8 of the spark plug 5 and at the second end to the F/B circuit 32 which works to measure the secondary voltage developed at the secondary coil 3 and the secondary current and feed them back to the control portion 13. Specifically, the second end of the secondary coil 3 is connected to the F/B circuit 32 through the diode 34 which serves to permit the secondary current to flow only in one direction. The F/B circuit 32 is connected to the shunt resistor 33 for measuring the secondary current.

The energy inputting driver 15 controls the on-off operations of the second signal 24 using the detected value of the secondary current feedback thereto and a command value of the secondary current, as derived using the current command signal IGa. Specifically, the energy inputting driver 15 determines threshold values of upper and lower limits of the detected value of the secondary current based on the command value and starts or stops outputting the control signal based on a result of comparison between the detected value and the upper and lower limit threshold values. More specifically, the energy inputting driver 15 stops outputting the control signal when the detected value of the secondary current exceeds the upper limit and alternatively starts outputting the control signal when the detected value of the secondary current is lower than the lower limit.

The first and second circuits 11 and 12, the F/B circuit 32, and the energy inputting driver 15 are installed in a single case as the ignition circuit unit 36. Each of the spark plug 5, the ignition coil 4, and the ignition circuit unit 36 is, as can be seen in FIG. 2, provided for the respective cylinder 7.

The operation of the ignition apparatus 1 when operating properly will be described below with reference to FIG. 4.

Figure 4:
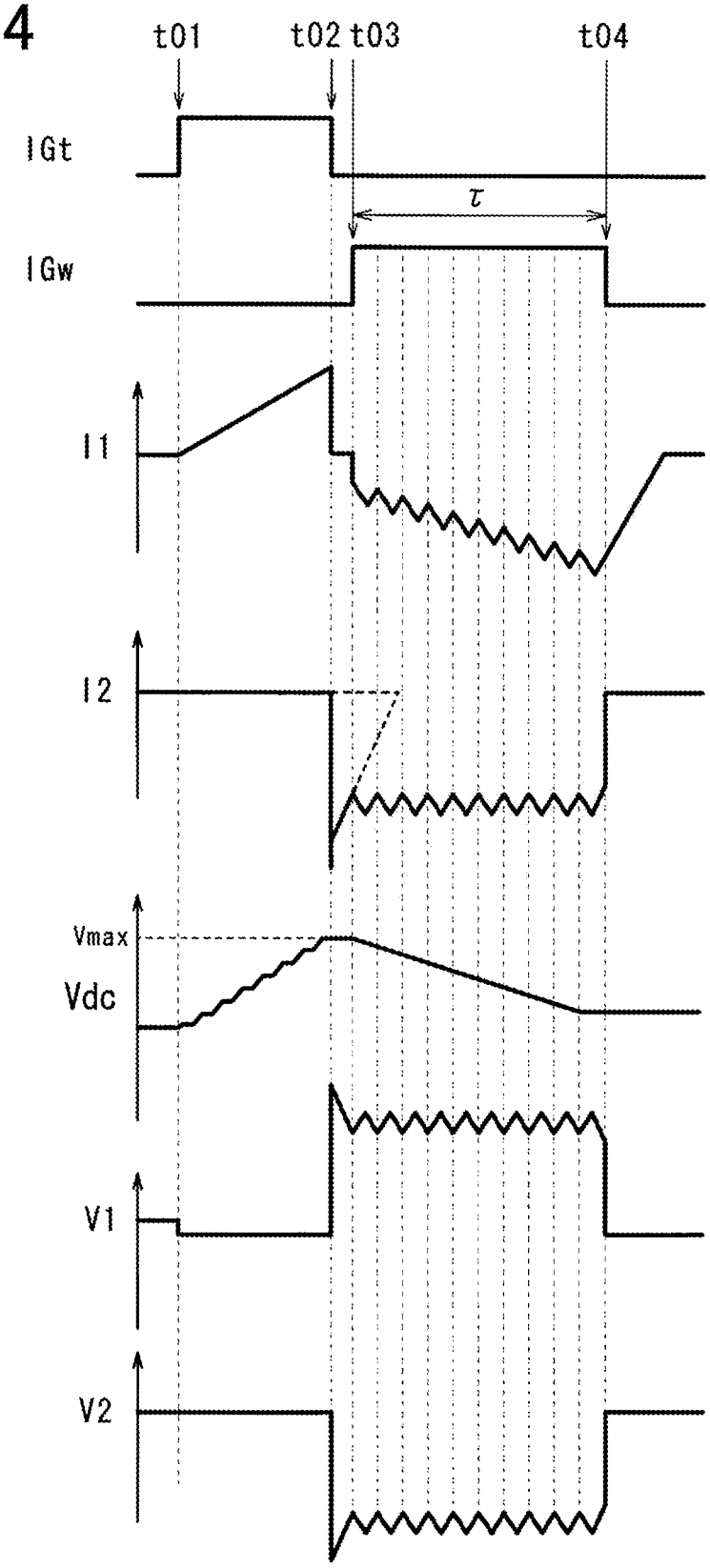
FIG. 4 is a time chart which demonstrates an operation of an ignition apparatus which is properly operating (embodiment).

In FIG. 4, "IGt" represents an input state of the ignition signal IGt using the high level or the low level. "IGw" represents an input state of the ignition signal IGt using the high level or the low level. "I1" and "V1" represent the primary current (i.e., the value of current flowing through the primary coil 2) and the primary voltage (i.e., the value of voltage applied to the primary coil 2), respectively. "I2" and "V2" represent the secondary current (i.e., the value of current flowing through the secondary coil 3) and the secondary voltage (i.e., the value of voltage applied to secondary coil 3), respectively. "Vdc" represents energy stored in the capacitor 26 in terms of voltage.

When the ignition signal IGt is changed from the low level to the high level at time t01, the first switch 22 is kept on for which the ignition signal IGt is in the high level, thereby producing a flow of the positive primary current, so that the energy is accumulated in the primary coil 2. The step-up switch 28 is turned on and off cyclically to store the step-upped energy in the capacitor 26.

Subsequently, when the ignition signal IGt is changed from the high level to the low level at time t02, the first switch 22 is turned off, thereby deenergizing the primary coil 2. This causes the secondary coil 3 to develop high voltage through electromagnetic induction, thereby creating the main spark-ignition in the spark plug 5. After the main spark-ignition occurs in the spark plug 5, the secondary current is damped in the form of a triangular wave (see a broken line of I2). The discharge-continuing signal IGw is changed from the low level to the high level at time t03 before the secondary current reaches the threshold value of the lower limit When the discharge-continuing signal IGw has been changed from the low level to the high level, the second switch 24 is turned on and off cyclically, thereby delivering or inputting the energy, as stored in the capacitor 26, to the negative side of the primary coil 2. The primary current flows from the primary coil 2 to the positive terminal of the battery 21. More specifically, each time the second switch 24 is turned on, the primary current is additionally delivered from the primary coil 2 toward the positive terminal of the battery 21, so that the primary current increases, in sequence, toward the negative side (see time t03 to time t04).

Each time the primary current is added to the battery 21, the secondary current which is oriented in the same direction as that in which the secondary current flows to create the main spark-ignition is sequentially added to the secondary coil 3, so that the secondary current is kept between the upper and lower limits.

In the above way, the second switch 24 is sequentially turned on and off, thereby causing the secondary current to continue to flow with a degree which maintains the discharge of sparks. This causes the continuing spark discharge to be achieved in the spark plug 5 as long as the discharge-continuing signal IGw is in the on-state.

The ECU 14 stores therein a command value indicating a target value E* of an input amount E of energy delivered by the second circuit 12 in each combustion cycle and a command value indicating the secondary current I2. The ECU 14 determines an energy input duration E in which the energy is delivered by the second circuit 12 based on the command values of the target value E* of the input amount E and the secondary current I2 and then continues to output the discharge-continuing signal IGw for a period of time that is the energy input duration E.

Feature of the Embodiment

Next, a characteristic structural of the embodiment will be described below.

The ECU 14 working as the control portion 13 calculates the length of a discharge path 38 (which will also be referred to as a path length L) between the electrodes of the spark plug 5 in a period of time for which the discharge-continuing signal IGw is outputted, and also calculates a time-sequential change rate ΔL/Δt. The ECU 14 has a threshold value of the path length L (which will also be referred to below as a first threshold value ε1) and a threshold value of the time-sequential change rate ΔL/Δt (which will also be referred to below as a second threshold value ε2). The ECU 14 operates the second circuit 12 in two control modes: a normal mode and a special mode.

The normal mode is a mode entered when the calculated value of the path length L is greater than the first threshold value ε1, and the calculated value of the time-sequential change rate ΔL/Δt is greater than the second threshold value ε2. The special mode is a mode entered when the calculated value of the path length L is smaller than the first threshold value ε1 or the calculated value of the time-sequential change rate ΔL/Δt is smaller than the second threshold value ε2. When the calculate value of the path length L is smaller than the first threshold value ε1 or the calculated value of the time-sequential change rate ΔL/Δt is smaller than the second threshold value ε2, the target value E* is increased.

Specifically, the ECU 14 monitors the path length L and the time-sequential change rate ΔL/Δt in the form of determinations using the threshold values for a period of time in which the energy is delivered by the second circuit 12. When at least one of the path length L and the time-sequential change rate ΔL/Δt has become too small (see FIGS. 3(*b*) and 6(*a*)), the ECU 14 determines that the ignition is expected to be delayed and then enters the special mode to increase the target value E* in order to control the delay of the ignition.

The determination of whether the special mode should be entered or not, that is, whether there is a high probability that the ignition will be delayed or not is made after a lapse of a given period of time since the energy was delivered by the second circuit.

An increment ΔE1 in the target value E* may be determined in various ways. The increment ΔE1 may be set constant or variable. For example, the increment ΔE1 may be increased with a decrease in calculated value of the path length L when the special mode is entered as a result of a determination about the path length L using the threshold value. The increment ΔE1 may also be increased with a decrease in calculated value of the time-sequential change rate ΔL/Δt when the special mode is entered as a result of a determination about the time-sequential change rate ΔL/Δt using the threshold value.

Figure 5:
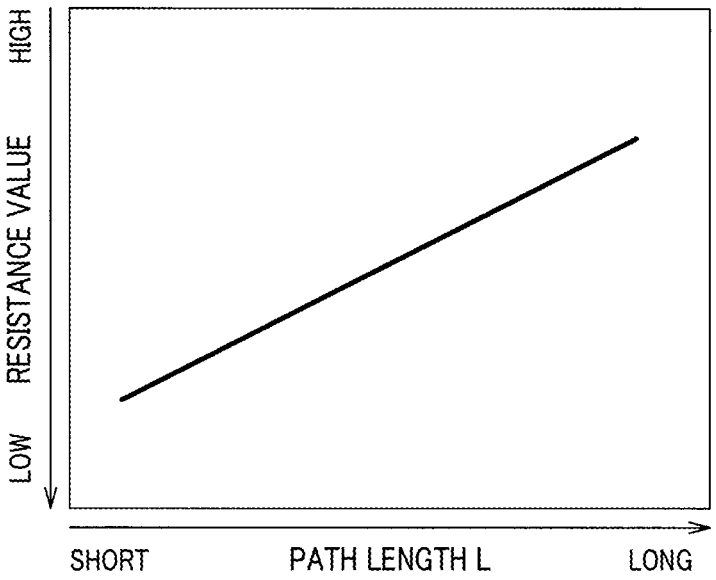
FIG. 5 is a view of a characteristic which represents a correlation between a path length of a spark and a resistance value of a discharge path (Embodiment).

The value of the path length L is calculated using, for example, the resistance value of the discharge path 38, an in-cylinder flow velocity v that is a rate of flow in the cylinder 7 of the internal combustion engine 6, a cylinder pressure P that is the pressure in the cylinder 7 of the internal combustion engine 6, and the air-fuel ratio AFR. Specifically, the ECU 14 calculates the resistance value of the discharge path 38 using detected values of the secondary voltage and the secondary current and then determines the value of the path length L using a correlation between experimentally derived values of the resistance value and values of the path length L (see FIG. 5). The ECU 14 also corrects the determined value of the path length L using the in-cylinder flow velocity v, the cylinder pressure P, and the air-fuel ratio AFR and determines it as the calculated value of the path length L.

The value of the in-cylinder flow velocity v is calculated using the speed, as derived by the rotational speed sensor 17. The value of the cylinder pressure P is calculated using, for example, the value of the intake pressure, as derived by the intake pressure sensor 18. The value of the air-fuel ratio AFR is calculated using an output of the air-fuel ratio sensor 19. The correction of the path length L using the in-cylinder flow velocity v, the cylinder pressure P, and the air-fuel ratio AFR is made using mapped data experimentally derived.

After entering the special mode, the ECU 14 monitors a short circuit of the discharge path 38 (see FIGS. 3(*c*), 6(*b*), and 6(*c*)). Specifically, after the special mode is entered, the ECU 14 determines whether the short has occurred or not which will be described later in detail. When determining the short has occurred, the ECU 14 greatly increases the target value E*.

Figure 6A:
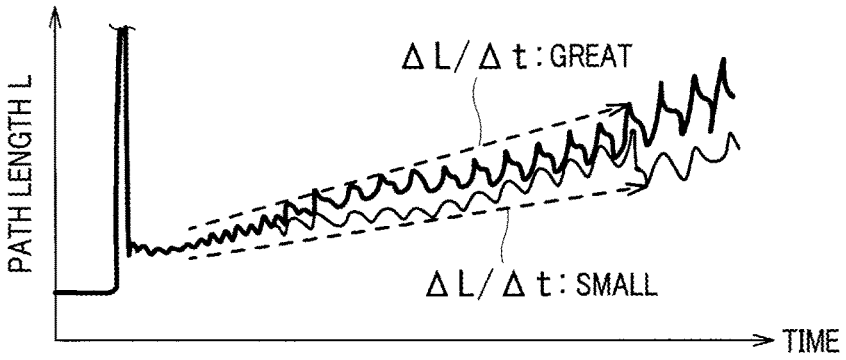
FIG. 6(*a*) is a time chart which represents a time sequential change in a path length when a time-sequential change rate of the path length is greater and when smaller (Embodiment).
Figure 6B:
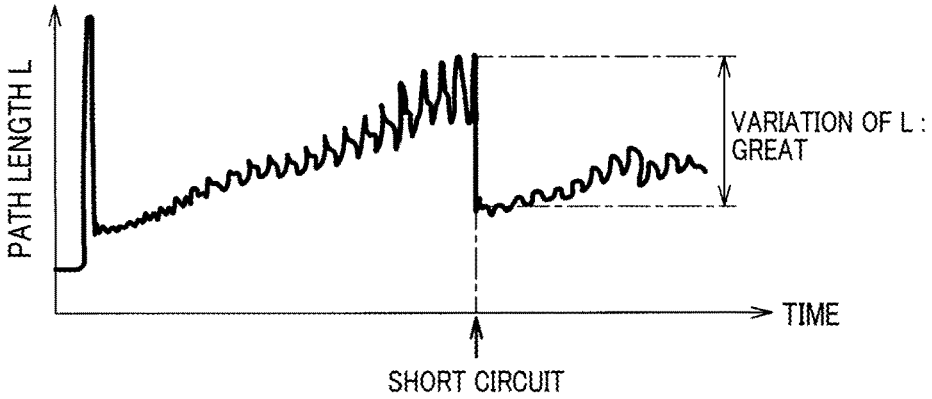
Figure 6C:
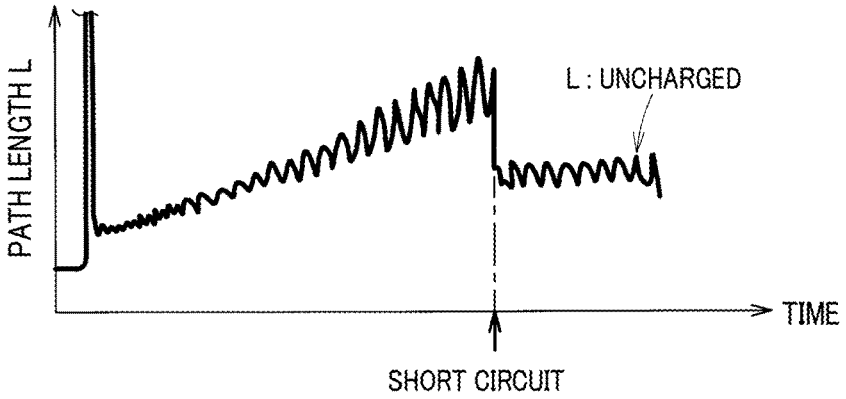

The greater increment in the target value E* may be determined in various ways. The greater increment may be set constant or variable. For example, the greater increment may be increased with an increase in change in path length L arising from the short circuit (see FIG. 6(*b*)) or an increase in change in time-sequential change rate ΔL/Δt resulting from the short circuit. Specifically, the greater increment is increased with an increase in difference or ratio between values of the path length L before and after the short circuit occurs or an increase in difference or ratio between values of the time-sequential change rate ΔL/Δt before and after the short circuit occurs.

In the following discussion, a portion of the greater increment which is calculated as a function of a change in the path length L resulting from the short circuit will be referred to an increment ΔE2. A portion of the greater increment which is calculated as a function of a change in the time-sequential change rate ΔL/Δt resulting from the short circuit will be referred to as an increment Δε3.

When determining that the short circuit has occurred, the ECU 14 also temporarily stops the energy input achieved by the second circuit 12 and then determines whether the discharge of a spark should be resumed by the first circuit 11 or not. This is because when the path length L is kept short without being increased (see FIG. 6(*c*)), or a surface spark occurs (see FIG. 3(*d*)) after the short circuit occurs, it will result in a great delay in the ignition. It is preferable that the ECU 14 stops the delivery of energy by the second circuit 12 and then resumes the discharge of sparks using the first circuit 11. The ECU 14 uses the following decision criterion to determine whether the discharge is required to be resumed or not.

Specifically the ECU 14 has a threshold value (which will also be referred to as a third threshold value ε3) for the time of first occurrence of the short circuit, a threshold value (which will also be referred to as a fourth threshold value ε4) for the time-sequential change rate ΔL/Δt after the short circuit occurs for the first time, and a threshold value (which will also be referred to as a fifth threshold value ε5) for a spark-to-spark interval between the first occurrence of the short circuit and the following occurrence of the short circuit. When the first short circuit has occurred earlier than the third threshold value ε3, the time-sequential change rate ΔL/Δt after the occurrence of the first short circuit is smaller than the fourth threshold value ε4, and the spark-to-spark interval has become greater than the fifth threshold value ε, the ECU 14 concludes that the resumption of a discharge of parks is needed, stops the delivery of energy by the second circuit 12, and then operates the first circuit 11 to create the main spark to resume the spark discharge.

The determination of whether the short circuit has occurred or not is made using detected values of the secondary voltage and the secondary current.

Specifically, the ECU 14 has a threshold value (which will also be referred to as a sixth threshold value ε6) for the secondary voltage, a threshold value (which will also be referred to as a seventh threshold value ε7) for the secondary current, and a threshold value (which will also be referred to as an eighth threshold value ε8) for the time-sequential change rate ΔV2/Δt of the secondary voltage. After the special mode is entered, the ECU 14 determines, as the time of occurrence of the short circuit, the time when a detected value of the secondary voltage is lower than or equal to the sixth threshold value E6, a detected value of the secondary current is lower than or equal to the seventh threshold value εt, and the time-sequential change rate ΔV2/Δt of the secondary voltage becomes greater than or equal to the eighth threshold value E8.

When no short circuit has occurred after the special mode is entered, the ECU 14 adds the increment ΔE1 to the initial target value E* to update the target value E* and then controls the operation of the second circuit 12 using the updated target value E*. When the short circuit has occurred after the special mode is entered, the ECU 14 also adds the increments ΔE1, ΔE2, and ΔE3 to the initial target value E* to update the target value E*, and then controls the operation of the second circuit 12 using the updated target value E*.

The ECU 14 prolongs the energy input duration T or increases the command value of the secondary current I2 based on a last derived value of the target value E* to substantially increase the energy input amount E.

The value of the secondary voltage is, as described above, fed back to the ECU 14. The ECU 14 may, therefore, be designed to determine the command value for the secondary voltage and then increase the command value of the secondary voltage V2 based on the increased target value E*, thereby substantially increasing the energy input amount E.

The initial target value E* before the energy input amount E is increased is given by an initial value E0 stored in the ECU 14. When the normal mode is entered, the initial value E0 continues to be used as the target value E* without increasing the target value E*. Alternatively, when the special mode is entered, and the discharge terminates, the initial value E0 may be updated as the increased target value E* (i.e., E0+ΔE1 or E0+ΔE1+ΔE2+ΔE3). When the initial value E0 has been updated, the ECU 14 may execute the ignition for several cycles using the updated initial value E0, and measure a variation in torque, and update the initial value E0 again as a function of the variation in torque. For instance, when the variation in torque is lower than a given value, the initial value E0 may be set to be low, while when the variation in torque is greater than the given value, the initial value E0 may be set to be high.

Control Method in Embodiment

Figure 7:
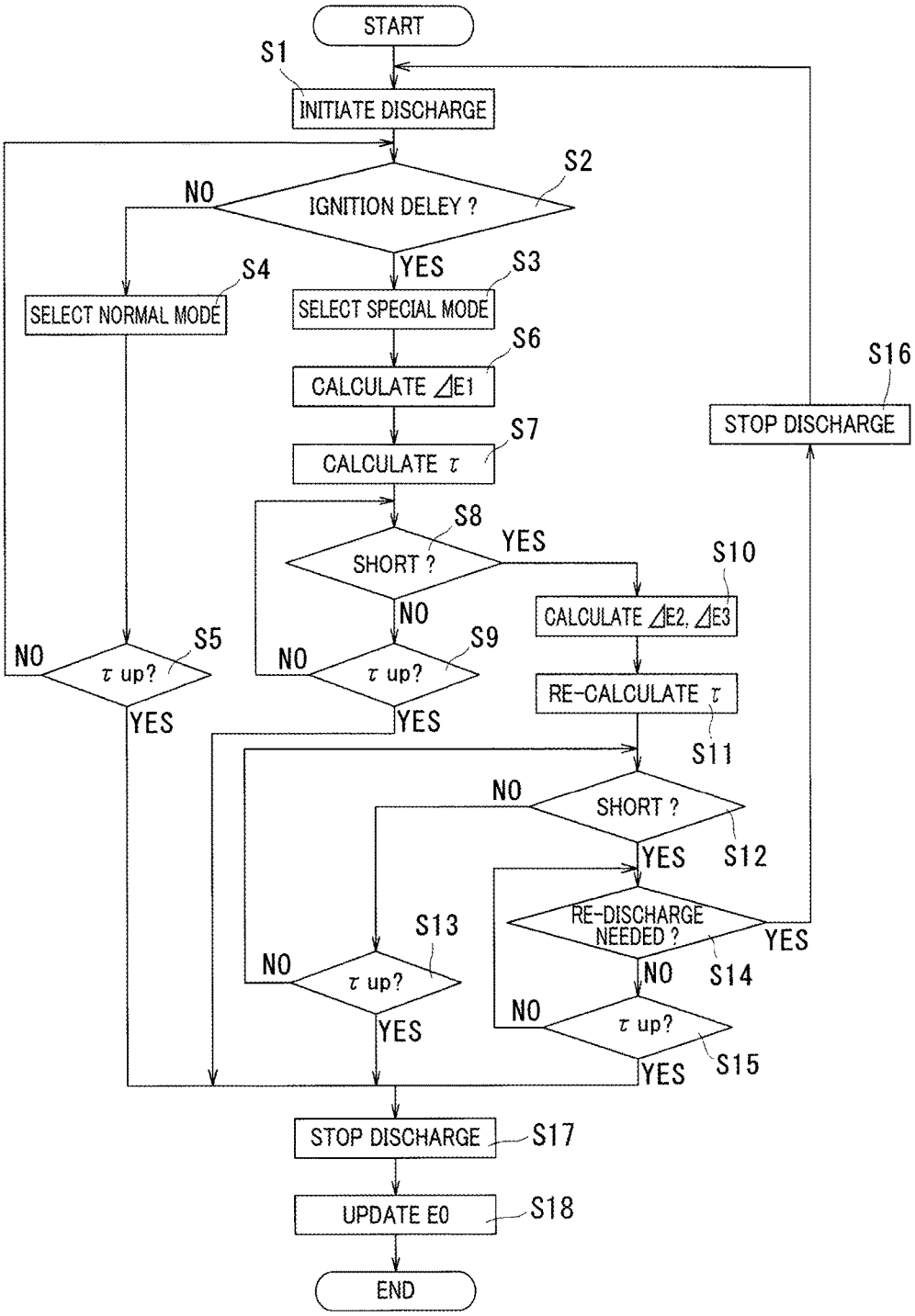
FIG. 7 is a flowchart which illustrates a control operation of an ignition apparatus (Embodiment).

The control operation of the ECU 14 to control the first and second circuits 11 and 12 will be described with reference to a flowchart illustrated in FIG. 7.

In step S1, the discharge of a spark is initiated. Specifically, the output of the ignition signal IGt is started and then stopped, thereby initiating the discharge of a spark using the first circuit 11 to achieve the main spark-ignition. Subsequently, the output of the discharge-continuing signal IGw is started to start delivering the energy using the second circuit 12 to continue the discharge of sparks. The ECU 14 starts monitoring the path length L and the time-sequential change rate ΔL/Δt at the same time as when the output of the discharge-continuing signal IGw is started.

Next, in step S2, it is determined whether there is a high probability that the ignition is delayed or not. This determination is started after a lapse of a given period of time following the start of output of the discharge-continuing signal IGw. If one of two conditions where the calculated value of the path length L is smaller than the first threshold value ε1 and where the calculated value of the time-sequential change rate ΔL/Δt is smaller than the second threshold value ε2 is met, it is determined that there is a high risk that the ignition is delayed. If the two conditions are not met, it is determined that the risk that the ignition is delay is low.

If it is determined that the risk that the ignition is delay is high (YES), the routine proceeds to step S3 wherein the special mode that is the control mode of the second circuit 12 is selected. Alternatively, if the risk that the ignition is delayed is low (NO), the routine proceeds to step S4 wherein the normal mode is selected. After step S4 wherein the normal mode is selected, the routine proceeds to step S5 wherein NO answer is obtained until the energy input duration E passes, that is, the delivery of energy using the second circuit 12 is continued to maintain the continuing spark discharge.

After step S3 wherein the special mode is selected, the routine proceeds to step S6 wherein the increment 4E1 is calculated and added to the target value E*. How to calculate the increment 4E1 has already been described. The routine then proceeds to step S7 wherein the updated target value E* is used to re-calculate the energy input duration E. The second circuit 12 then continues to deliver the energy using the re-calculated energy input duration E.

Afterwards, the routine proceeds to step S8 in the special mode wherein it is determined whether the discharge of a spark is short-circuited or not. The determination of whether the short circuit has occurred or not is made in the way as described above. If it is determined that the short circuit has not occurred (NO), then the routine proceeds to step S9 wherein NO answer is obtained until the energy input duration E passes. The determination of whether the short circuit has occurred or not in step S8 is continued.

Alternatively, if it is determined that the short circuit has occurred, the routine proceeds to step S10 wherein the increments 4ε2 and 4E3 are calculated and added to the target value E*. The calculation of the increments 4ε2 and 4E3 is made in the way as described above. The routine then proceeds to step S11 wherein the energy input duration E is re-calculated using the updated target value E*. The second circuit 12 then continues to deliver the energy using the re-calculated energy input duration E.

Afterwards, the routine proceeds to step S12 in the special mode wherein it is determined whether the spark discharge has been short-circuited again or not. If it is determined that the short circuit has not occurred again (NO), then the routine proceeds to step S13 wherein the determination of whether the short circuit has occurred or not is continued, that is, the determination in step S12 is continued until the energy input duration E passes.

If it is determined that the short circuit has occurred again, then the routine proceeds to step S14 wherein the resumption of a discharge is needed or not. The determination of whether it is necessary to re-discharge a spark or not is made in the way as described above. If the re-discharge is not needed (NO), then the routine proceeds to step S15 wherein the determination in step S14 as to whether the re-discharge is needed or not is made until the energy input duration E passes.

Alternatively, if it is determined that the re-discharge is needed, then the routine proceeds to step S16 wherein the ECU 14 stops the second circuit 12 from delivering the energy to temporarily terminate the spark discharge and then returns back to step S1 to resume a discharge of a spark.

If it is determined (YES) in step S5, S9, S13, or S15 that the energy input duration E has passed, then the routine proceeds to step S17 wherein the ECU 14 stops the second circuit 12 from delivery the energy to terminate the spark discharge. The routine then proceeds to step S18 wherein the initial value E0 is updated as the increased target value E* (i.e., E0+ΔE1 or E0+ΔE1+ΔE2+ΔE3).

Beneficial Effect of the Embodiment

The ignition apparatus 1 of the embodiment has the ECU 14 which monitors the path length L and the time-sequential change rate ΔL/Δt using the threshold values for a period of time in which the second circuit 12 delivers the energy to the spark plug 5. When determining that at least one of the path length L and the time-sequential change rate ΔL/Δt has becomes too small, the ECU 14 determines that the ignition is expected to be delayed and then enters the special mode to increase the target value E* in order to control the delay of the ignition.

This embodiment focuses on the fact that the variation in ignition, especially, the delay of the ignition is caused by a decrease in the path length L. In other words, the ignition is achieved by extension of a spark by a gas flow in the cylinder 7, thereby prolonging the path length L. Therefore, when the path length L is short, there is a risk that the ignition is delayed.

Accordingly, this embodiment monitors the path length L and the time-sequential change rate ΔL/Δt in the form of threshold determinations. When at least one of the path length L and the time-sequential change rate ΔL/Δt has become small, the special mode is selected to increase the energy input amount E using the second circuit 12. This minimizes the delay of the ignition caused by the fact that the path length L does not become long. The ignition apparatus 1 designed to use the second circuit 12 in continuing the spark discharge is, therefore, capable of decreasing the variation in ignition without increasing the energy input amount E.

Figure 8A:
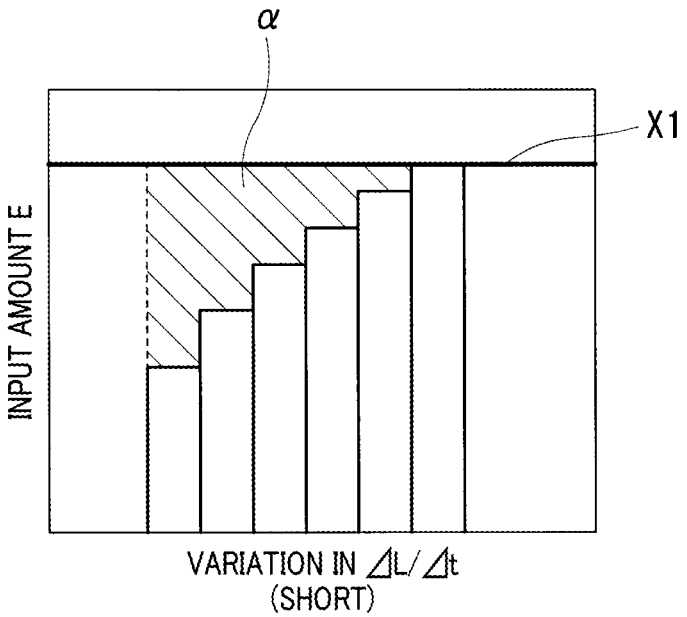
FIG. 8(*a*) is an explanatory view which represents a relation between a variation in a time-sequential change rate and an energy input amount in the event of a short circuit (Embodiment).
Figure 8B:
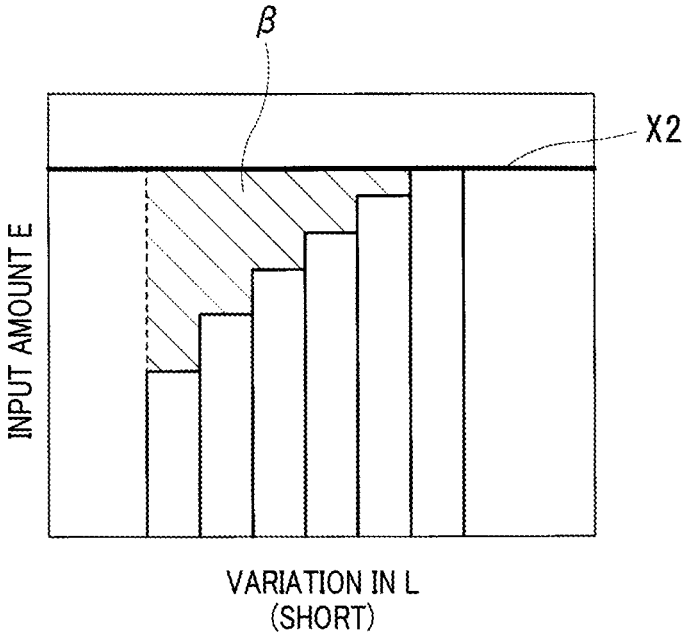

In the special mode, the energy input amount E is increased using the second circuit 12 with an increase in variation in the time-sequential change rate ΔL/Δt resulting from the occurrence of the short circuit. This enables an increase in the energy input amount E required to decrease the variation in the ignition to be properly regulated. In other words, the smaller a ratio or difference in the time-sequential change rate ΔL/Δt before and after the short circuit occurs, the smaller the energy input amount E required to eliminate the delay of the ignition (see FIG. 8(*a*)). The histogram in FIG. 8(*a*) represents the energy input amount E which is required to eliminate the delay of the ignition and quantified when the ignition delay/the energy input amount E becomes lower than a given threshold value.

Therefore, the energy input amount E is increased with an increase in variation in the time-sequential change rate ΔL/Δt arising from the occurrence of a short circuit, thereby properly regulating an amount by which the energy input amount E is required to be increased to decrease the variation in the ignition, which minimizes an excess of the input energy. For instance, as compared with the case where the energy input amount E which is suitable for a maximum difference in the time-sequential change rate ΔL/Δt when the short circuit is occurring is fixed (see a straight horizontal line X1 in FIG. 8(*a*)), an excess of the energy in a range a, as enclosed by the straight horizontal line and the histogram, is decreased by regulating the energy input amount E as a function of a variation in the time-sequential change rate ΔL/Δt when the short circuit is occurring.

When, after it is determined that the short circuit has occurred, the short circuit also has occurred again in the special mode, the ECU 14 determines whether the second circuit 12 should be stopped from maintaining the continuing spark discharge for determining whether the main spark-ignition should be initiated again by the first circuit 11, that is, whether it is necessary to discharge a spark again or not. This enables a re-discharge to be performed when there is a high risk that the path length L is undesirably kept short, or the surface spark is created, which will lead to a great delay of the ignition, thereby eliminating such a risk.

In the special mode, the greater a variation in the path length L arising from the short circuit, the more the energy input amount E is increased by the second circuit 12. This properly regulates an amount by which the energy input amount E is required to decrease the variation in the ignition. In other words, the smaller a ratio or difference in the path length L before and after the short circuit occurs becomes, the smaller the energy input amount E required to eliminate the delay of the ignition will be (see FIG. 8(*b*)). The histogram in FIG. 8(*b*) represents the energy input amount E which is required to eliminate the delay of the ignition and quantified when the ignition delay/the energy input amount E becomes lower than a given threshold value.

Therefore, the energy input amount E is increased with an increase in variation in the path length L arising from the short circuit, thereby properly regulating an amount by which the energy input amount E is required to be increased to decrease the variation in the ignition, which minimizes an excess of the input energy. For instance, as compared with the case where the energy input amount E which is suitable for a maximum difference in the path length L when the short circuit is occurring is fixed (see a straight horizontal line X2 in FIG. 8(*b*)), an excess of the energy in a range, as enclosed by the straight horizontal line and the histogram, is decreased by regulating the energy input amount E as a function of a variation in the time-sequential change rate ΔL/Δt when the short circuit is occurring.

Figure 9:
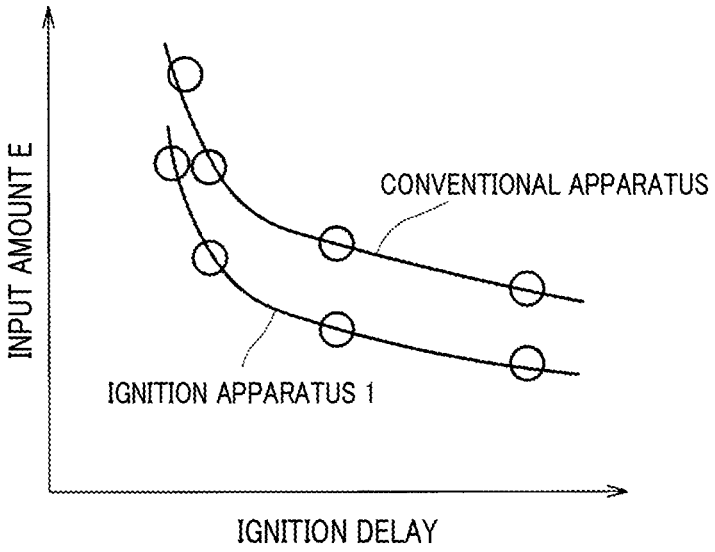
FIG. 9 is a view of a characteristic which represents a relation between an ignition delay and an energy input amount.

FIG. 9 illustrates a comparison between a conventional apparatus which is equipped with the first and second circuits 11 and 12 and fixes the energy input amount E and the ignition apparatus 1 of this embodiment and shows that the energy input amount E may be decreased. Therefore, the ignition apparatus 1 is capable of decreasing the energy input amount E as compared with the conventional apparatus. When the energy input amount E is the same between the ignition apparatus 1 and the conventional apparatus, the ignition apparatus 1 is capable of decreasing the delay of the ignition as compared with the conventional apparatus.

Modifications

The ignition apparatus 1 may be modified in various ways without being limited to the embodiments. For example, the ignition apparatus 1 of the embodiment selects the special mode or the normal mode based on the threshold determinations of both the path length L and the time-sequential change rate ΔL/Δt, but however, may be designed to select the special mode or the normal mode based on the threshold determination of either of the path length L or the time-sequential change rate ΔL/Δt.

The ignition apparatus 1 of the embodiment calculates the path length L based on the resistance value of the discharge path 38, the in-cylinder flow velocity v, the cylinder pressure P, and the air-fuel ratio AFR, but however, may be designed to have a first detecting portion which detects or calculates electrical physical quantities, such as the secondary voltage and the resistance value of the discharge path 38 and a second detecting portion which detects or calculates physical quantities of intake air or air-fuel mixture, such as the in-cylinder flow velocity v, the cylinder pressure P, and the air-fuel ratio AFR. The ignition apparatus may work to use at least one of the physical quantities, as detected or calculated by the first detecting portion, and at least one of the physical quantities, as detected or calculated by the second detecting portion, to determine the path length L.

The ignition apparatus 1 of the embodiment calculates the in-cylinder flow velocity v based on the detected value of the rotational speed sensor 17 and also calculates the cylinder pressure P based on the detected value of the intake pressure sensor 18, but however, may alternatively be designed to have, as sensors outputting signals to the ECU 14, a flow rate sensor which detects a flow rate of intake air sucked into the cylinder 7 and an intake temperature sensor which detects the temperature of the intake air and to calculate the in-cylinder flow velocity v and the cylinder pressure P using detected values of parameters, as derived by the above sensors.

The ignition apparatus 1 of the embodiment prolongs the energy input duration E to increase the energy input amount E, but however, may be designed to increase the command value for the secondary current or the secondary voltage to increase the energy input amount E.

The embodiment shows an example where the ignition apparatus 1 is used in the gasoline internal combustion engine 6, but may be applied to the internal combustion engine 6 which is designed to use ethanol fuel or blended fuel or may employ a low-quality fuel.

The embodiment shows an example where the ignition apparatus 1 is applied to the internal combustion engine 6 capable of achieving lean-burn of fuel, but however, is not limited thereto because the continuing spark discharge can be established to improve the ignitability in different status of fuel combustion. The ignition apparatus 1 may be used with the internal combustion engine 6 designed not to execute the lean-burn of fuel.

The embodiment shows an example where the ignition apparatus 1 is applied to the direct injection type of internal combustion engine 6 which inject fuel directly into the cylinder 7, but however, may be used with a port injection type of the internal combustion engine 6 designed to inject fuel into an intake port. The embodiment also shows an example where the ignition apparatus 1 is used with the internal combustion engine 6 which actively produces a spiral flow of the mixture in the cylinder 7, but however, may alternatively be used with the internal combustion engine 6 designed not to have a mechanism which actively produces the spiral flow of the mixture in the cylinder 7.

The invention claimed is:

1. An ignition apparatus for an internal combustion engine which is equipped with an ignition coil including a primary coil and a secondary coil and a spark plug connected to the secondary coil and works to input energy to said spark plug using electromagnetic induction resulting from energization and deenergization of the primary coil to produce a discharge of a spark, comprising:

a first circuit which energizes or deenergizes said primary coil to initiate the discharge of a spark in said spark plug;

a second circuit which produces a flow of current through said primary coil in a direction opposite a direction in which a flow of current through said primary coil was produced by the first circuit during the discharge of the spark initiated by the first circuit, thereby keeping a flow of current through the secondary coil in the same direction as when a flow of current through the secondary coil has been initiated by the first circuit, to continue spark discharge; and a control portion which controls operations of the first circuit and the second circuit, wherein the control portion works to calculate a path length of the discharge of a spark between electrodes of the spark plug and has a threshold value for the path length, the control portion having, as control modes for the second circuit, a normal mode in which is entered when a calculated value of the path length is greater than said threshold value and a special mode which is entered when the calculated value of the path length is smaller than said threshold value, and wherein in the special mode, an energy input amount of energy inputted by said second circuit is increased to be more than that in the normal mode.

2. An ignition apparatus for an internal combustion engine which is equipped with an ignition coil including a primary coil and a secondary coil and a spark plug connected to the secondary coil and works to input energy to said spark plug using electromagnetic induction resulting from energization and deenergization of the primary coil, comprising:

a first circuit which energizes or deenergizes said primary coil to initiate a discharge of a spark in said spark plug;

a second circuit which produces a flow of current through said primary coil in a direction opposite a direction in which a flow of current through said primary coil was produced by the first circuit during the discharge of the spark initiated by the first circuit, thereby keeping a flow of current through the secondary coil in the same direction as when a flow of current through the secondary coil has been initiated by the first circuit, to continue a discharge of sparks; and a control portion which controls operations of the first circuit and the second circuit, wherein the control portion works to calculate a path length of the discharge of a spark between electrodes of the spark plug to determine a time-sequential change rate of the path length and has a threshold value for the time-sequential change rate, the control portion having, as control modes for the second circuit, a normal mode which is entered when a determined value of the time-sequential change rate is greater than said threshold value and a special mode which is entered when the determined value of the time-sequential change rate is smaller than said threshold value, and wherein in the special mode, an energy input amount of energy inputted by said second circuit is increased to be more than that in the normal mode.

3. An ignition apparatus as set forth in claim 1, wherein said control portion calculates a time-sequential change rate of the path length and monitors a short circuit of a path of said discharge of the spark in the special mode, and wherein when the short circuit has occurred, the control portion increases the energy input amount of the energy inputted by the second circuit with an increase in a variation in the time-sequential change rate arising from the short circuit.

4. An ignition apparatus as set forth in claim 1, wherein said control portion calculates a time-sequential change rate of the path length and monitors a short circuit of a path of said discharge of the spark in the special mode, said control portion also determining whether resumption of the discharge of a spark, as achieved by the first circuit, is required or not after the short circuit occurs, and wherein the control portion has a threshold value for a time of first occurrence of the short circuit, a threshold value for a time-sequential change rate of the path length after the first occurrence of the short circuit, and a threshold value for a spark-to-spark interval between the first occurrence of the short circuit and a following occurrence of the short circuit, wherein when the first occurrence of the short circuit is earlier than the threshold value provided for the time of the first occurrence, when the time-sequential change rate after the first occurrence of the short circuit is smaller than the threshold value for the time-sequential change rate, and when the spark-to-spark interval has become greater than the threshold value for the spark-to-spark interval, the control portion concludes that resumption of a discharge of a park is needed, stops the second circuit from inputting the energy, and then operates the first circuit to resume the discharge of a spark.

5. An ignition apparatus as set forth in claim 1, wherein in the special mode, said control portion monitors a short circuit of a path of the discharge of the spark and increases an energy input amount of energy inputted by the second circuit with an increase in variation in said path length arising from the short circuit.

6. An ignition apparatus as set forth in claim 3, further comprising a secondary voltage detector which detects a secondary voltage that is voltage developed at the secondary coil, and a secondary current detector which detects a secondary current that is a flow of current through the secondary coil, and wherein said control portion has a threshold value for a detected value of the secondary voltage, a threshold value for a detected value of the secondary current, and a threshold value for a time-sequential change rate of the secondary voltage, wherein when the detected value of the secondary voltage is lower than or equal to the threshold value for the secondary voltage, when the detected value of the secondary current is lower than or equal to the threshold value of the secondary current, and when the time-sequential change rate of the secondary voltage becomes higher than or equal to the threshold value for the time-sequential change rate, the control portion concludes that the short circuit has occurred.

7. An ignition apparatus as set forth in claim 1, further comprising a first detecting portion which detects or calculates at least one of a secondary voltage that is voltage developed at the secondary coil and a resistance value between electrodes of the spark plug, and a second detecting portion which detects or calculates at least one of an in-cylinder flow velocity that is a rate of flow in a cylinder of the internal combustion engine, a cylinder pressure that is pressure in the cylinder of the internal combustion engine, and an air-fuel ratio, and wherein the control portion calculates the path length based on a physical quantity detected or calculated by the first detecting portion and a physical quantity detected or calculated by the second detecting portion.

8. An ignition apparatus as set forth in claim 1, wherein in the special mode, the control portion increases at least one of the an energy input duration in which the energy is inputted by the second circuit, a secondary current that is a flow of current through the secondary coil, and a secondary voltage that is voltage developed at the secondary coil to increase the energy input amount of the energy inputted by said second circuit.

* * * * *